US011287239B1

(12) United States Patent
Polk et al.

(10) Patent No.: US 11,287,239 B1
(45) Date of Patent: Mar. 29, 2022

(54) FAST UTILITY ACCESS DEVICE AND METHOD OF USE THEREOF

(71) Applicant: Combat Capabilities Development Command, Chemical Biological Center, Apg, MD (US)

(72) Inventors: Amee L Polk, Havre de Grace, MD (US); Joseph A Domanico, Bel Air, MD (US); Michael F Kauzlarich, Edgewood, MD (US); Nino L Bonavito, Perry Hall, MD (US); Warren L Gardner, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/937,113

(22) Filed: Jul. 23, 2020

Related U.S. Application Data

(60) Provisional application No. 62/879,019, filed on Jul. 26, 2019.

(51) Int. Cl.

| | |
|---|---|
| ***F42D 1/04*** | (2006.01) |
| ***C06B 33/00*** | (2006.01) |
| ***F42D 3/02*** | (2006.01) |

(52) U.S. Cl.
CPC ..... *F42D 1/043* (2013.01); *C06B 33/00* (2013.01); *F42D 3/02* (2013.01)

(58) Field of Classification Search
CPC . C06B 33/00; F42D 3/02; F42D 1/043; F42D 3/00; F42B 12/204; F42B 3/22; B23K 7/00
See application file for complete search history.

(56) References Cited

U.S. PATENT DOCUMENTS

| | | | | |
|---|---|---|---|---|
| 3,185,089 A * | 5/1965 | Parkhurst | F42B 3/093 | 102/307 |
| 3,374,737 A * | 3/1968 | Pike | F42B 1/02 | 102/275.5 |
| 3,744,369 A * | 7/1973 | Marziano | F42D 3/00 | 89/1.14 |
| 4,216,721 A * | 8/1980 | Marziano | F42B 12/44 | 102/306 |
| 5,383,405 A * | 1/1995 | Everest | C06C 5/04 | 102/275.8 |

(Continued)

*Primary Examiner* — Joshua T Semick
(74) *Attorney, Agent, or Firm* — Ulysses John Biffoni

(57) ABSTRACT

A fast utility access device (FUAD) is provided that includes one or more casings, each of the one or more casings collectively defining a bore, and a core of a highly exothermic composition contained in the bore and surrounded by a thermally insulating inner liner, the highly exothermic composition ignitable to create a post-ignition temperature of between 500° C. and 4000° C. A method is also provided for breaching a target and includes contacting the inventive access device with a breaching target substrate, thermally coupling at least one reaction initiator to the highly exothermic composition, triggering the at least one reaction initiator thereby igniting the highly exothermic composition, and allowing the highly exothermic composition to achieve a post-ignition temperature sufficient to melt the breaching target substrate, forming a hole therethrough.

20 Claims, 2 Drawing Sheets

(56) References Cited

U.S. PATENT DOCUMENTS

| | | | | |
|---|---|---|---|---|
| 5,936,184 | A * | 8/1999 | Majerus | F42B 33/06 89/1.13 |
| 6,183,569 | B1 * | 2/2001 | Mohler | B23K 7/00 148/194 |
| 6,766,744 | B1 * | 7/2004 | Song | F42B 1/02 102/311 |
| 7,536,956 | B2 * | 5/2009 | Sammons | F42B 1/036 102/476 |
| 7,555,906 | B2 * | 7/2009 | Anichini | F23R 3/007 60/799 |
| 2003/0145752 | A1 * | 8/2003 | Carter, Jr. | B23K 7/08 102/335 |

* cited by examiner

FAST UTILITY ACCESS DEVICE AND METHOD OF USE THEREOF

CROSS REFERENCE TO RELATED APPLICATIONS

This application claims priority benefit of U.S. Provisional Application Ser. No. 62/879,019 filed Jul. 26, 2019; the contents of which are hereby incorporated by reference.

GOVERNMENT INTEREST

The invention described herein may be manufactured, used, and/or licensed by or for the United States Government.

FIELD OF THE INVENTION

The present invention is directed generally to highly exothermic compositions and methods of use thereof, and in particular to access devices containing highly exothermic compositions and methods of use thereof for breaching a variety of substrates with minimal collateral damage.

BACKGROUND OF THE INVENTION

Highly exothermic compositions have been successfully utilized in a variety of applications to provide elevated temperatures without the equipment associated with a welding torch. Thermite is a common highly exothermic pyrotechnic composition of a first metal powder and an oxide with which the metal undergoes an exothermic reduction-oxidation reaction that generates intense heat and high temperature focused on a small area without an attendant explosion.

Metals conventionally used in thermite compositions illustratively include aluminum, magnesium, titanium, zinc, silicon, and boron; while metal oxides used in thermite compositions illustratively include iron(II, III) oxide, chromium(III) oxide, boron(III) oxide, lead(II, IV) oxide, copper (II) oxide, silicon(IV) oxide, boron(III) oxide, and manganese(IV) oxide. Thermites are used in a variety of civilian, law enforcement, and military sectors. In the civilian sector, thermites are commonly used for welding, illustratively for use in railway welding. In military and law enforcement sectors, thermites are typically used in the form of thermite grenades and charges for ordnance neutralization and material destruction, illustratively including the disabling of artillery pieces. Thermite is also used in incendiary bombs.

One non-traditional application of thermite that has been recently explored in the military sector is the use of thermite to breach barriers. Current barrier breaching solutions require the use of high explosives or projectiles on building and vehicle targets which poses a variety of risks. High explosives and projectiles generate significant noise and explosive force when they explode causing a variety of strategic battlefield problems illustratively including significantly increasing the risk of alerting the enemy of soldiers' position, hindering or preventing covert battlefield operations, preventing inconspicuous presence and movement of soldiers throughout the battlefield, eliminating the beneficial element of surprise, and increasing the risk of lethal danger to soldiers on the battlefield.

A considerable risk of collateral damage exists with the limited control explosion when breaching with a high explosive or projectile. Collateral damage in this context includes potential casualties, unnecessary damage to nearby structures, and unnecessary damage to the breaching target structure. The uncontrolled explosion often creates a hole in the breaching target that has jagged or sharp edges which pose a risk of laceration to someone entering the hole in the breaching target. As such, explosive breaching cannot be used in a variety of settings.

As a result, traditional breaching solutions have used powered saws, plasma arc cutters, and other similar electrically or gas driven equipment that provides a controlled breach but at the expense of being cumbersome to carry and deploy. Traditional breaching equipment solutions can also be time-intensive, with assembly, application to a breaching target, and disassembly taking too much time under emergency conditions.

Thus, there exists a need for an improved breaching solution that provides the speed and ease of use of explosives with the control of equipment based breaching. There further exists a need for a breaching solution that is readily reconfigured in the field to adjust the size and shape of the needed breach.

SUMMARY OF THE INVENTION

A fast utility access device (FUAD) is provided that includes one or more casings, each of the one or more casings collectively defining a bore, and a core of a highly exothermic composition contained in the bore and surrounded by a thermally insulating liner, the highly exothermic composition ignitable to create a post-ignition temperature of between 500° C. and 4000° C.

A method is also provided for breaching a target and includes contacting the inventive FUAD with a breaching target substrate, thermally coupling at least one reaction initiator to the highly exothermic composition, triggering the at least one reaction initiator thereby igniting the highly exothermic composition, and allowing the highly exothermic composition to achieve a post-ignition temperature sufficient to melt the breaching target substrate, forming a hole therethrough.

BRIEF DESCRIPTION OF THE DRAWINGS

The present invention is further detailed with respect to the following figures and detailed description of the invention that depict and describe various aspects of the present invention. In the figures, identical structures, elements, or parts that appear in more than one figure are generally labeled with the same numeral in all the figures in which they appear. Dimensions of components and features shown in the figures are generally chosen for convenience and clarity of presentation and are not necessarily shown to scale.

DETAILED DESCRIPTION OF THE PREFERRED EMBODIMENTS

Figure 1:
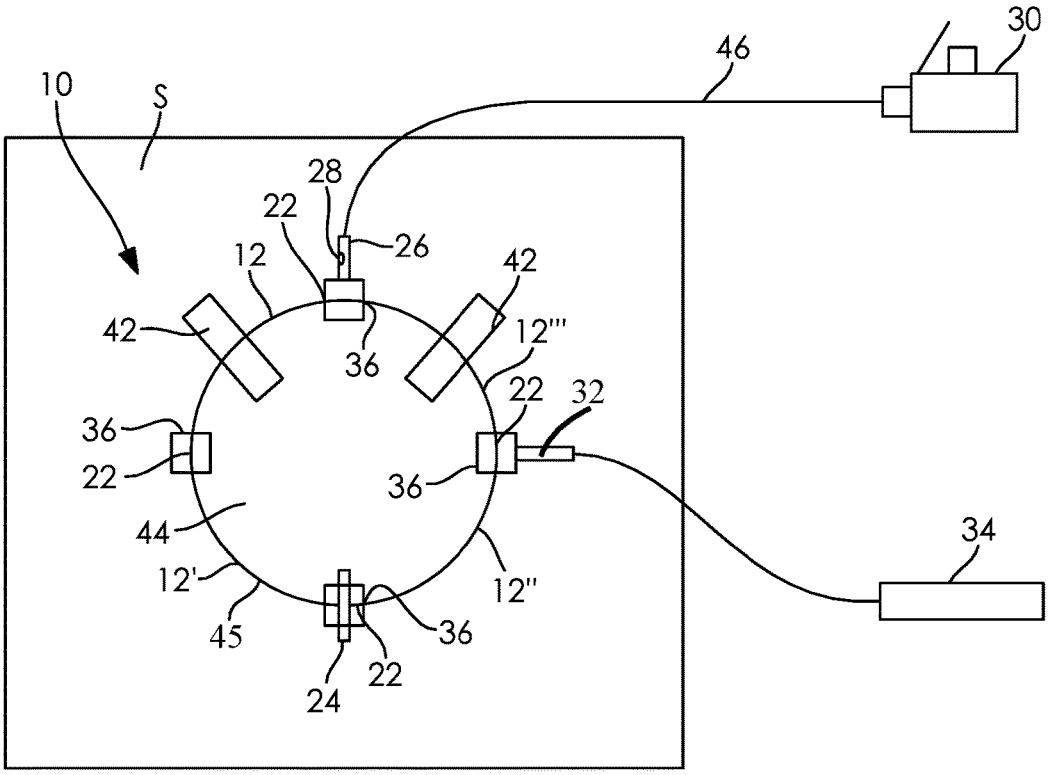
FIG. 1 illustrates a FUAD formed of several casings joined together with connectors into a complete circle and in contact with a breaching target substrate in accordance with embodiments of the invention.

The present invention has utility as a fast utility access device (FUAD) containing therein a core of a highly exothermic composition. The present invention is lighter than equipment based breaching solutions, can be quickly assembled, ignited, and disassembled, and can quietly and cleanly breach a variety of breaching target substrates. The present invention is directed to these, as well as to other important needs in the art.

The FUAD can be assembled by a single person, placed into contact with a breaching target substrate, and ignited in five minutes or less. When the highly exothermic composition is ignited it reaches a post-ignition temperature of between 500° C. and 4000° C. without producing an explosive force and compromises a variety of breaching target substrates in contact with the FUAD by melting a hole therethrough absent jagged or sharp edges in the breaching target substrate common to explosive breaches. The highly exothermic composition also limits collateral damage and unnecessary structural damage to a breaching target. This has important implications in rescue operations in which a victim is trapped behind a structurally weakened breach target as might be found in earthquakes and engineering failures.

The present invention has further utility as a method for breaching a target by contacting the FUAD with a breaching target substrate, thermally coupling at least one reaction initiator to the highly exothermic composition, triggering the at least one reaction initiator thereby igniting the highly exothermic composition, and allowing the highly exothermic composition to achieve a post-ignition temperature sufficient to melt the breaching target substrate, forming a hole therethrough free of jagged or sharp edges.

The inventive FUAD and method of use thereof provide a variety of improvements over the traditional breaching devices and methods commonly used in the art. By way of non-limiting example, the inventive FUAD and method of use thereof provides several battlefield advantages that protect the safety of soldiers by quietly melting through a breaching substrate without producing explosive force, thereby minimizing the risk of alerting the enemy of soldiers' position, maintaining the integrity of covert battlefield operations and inconspicuous presence and movement of soldiers throughout the battlefield. The beneficial element of surprise is often a critical component in mission success and minimizing the risk of mortal danger to soldiers on the battlefield. The inventive FUAD is also lighter and less cumbersome than traditional breaching devices, thereby increasing a soldier's mobility relative to the heavy logistical load of equipment breaching devices. The inventive FUAD can be carried and assembled and activated by one soldier to achieve target breach in less than five minutes—a shorter time frame than that generally required with equipment breaching devices commonly used in the art. The inventive FUAD and method of use thereof also create a smooth hole that is free of sharp or jagged edges by melting through a breaching target substrate, thereby minimizing the risk of laceration posed to soldiers entering the hole in a breaching target.

In this disclosure, "comprises," "comprising," "having," "includes," and "including," have the open-ended meaning ascribed to them in U.S. Patent law. "Consisting essentially of" or "consists essentially" likewise has the meaning ascribed in U.S. Patent law and is open-ended to the extent it allows for the presence of more than that which is recited so long as basic or novel characteristics of that which is recited is not changed by the presence of more than that which is recited, but excludes prior art embodiments.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4. By way of further example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "or" is understood to be inclusive. Unless specifically stated or obvious from context, as used herein, the terms "a," "an," and "the" are understood to be singular or plural.

Also, as used herein, "and/or" refers to and encompasses any and all possible combinations of one or more of the associated listed items, as well as the lack of combinations when interpreted in the alternative ("or").

The suffix "(s)" as used herein is intended to include both the singular and the plural of the term that it modifies, thereby including one or more of that term.

Reference throughout the specification to "one embodiment", "another embodiment", "an embodiment", and so forth, when present, means that a particular element (e.g., feature, structure, and/or characteristic) described in connection with the embodiment is included in at least one embodiment described herein, and may or may not be present in other embodiments. In addition, it is to be understood that the described elements may be combined in any suitable.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

Figure 5:
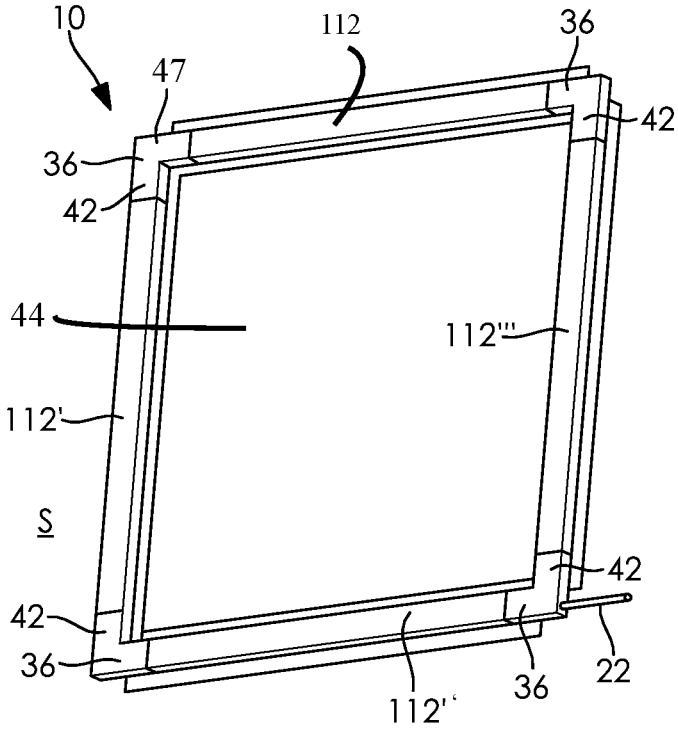
FIG. 5 illustrates a FUAD formed of from several casings joined together with connectors into a unitary rectangle in accordance with embodiments of the invention.

Referring now to the figures, where like reference numerals refer to the same aspects of the invention across different drawings, a FUAD according to embodiments of the present invention is shown generally at 10. In FIG. 1 the FUAD 10 is shown in contact with a breaching target substrate, S. While the substrate S is depicted as planar, it is appreciated that contoured substrates are readily breached by the present invention. The FUAD 10 includes one or more casings 12, 12', 12" and 12'", each of the one or more casings, referred to collectively as 12 are adapted to collectively define a breach 44. While the breach 44 is depicted as circular and approximately defines the size of the breach 44, it is appreciated that other shapes are readily defined include a slit, a triangle, a rectilinear shape, irregular shapes, and higher polygons having from 5 to 10 sides. FIG. 5 shows a rectilinear breach 44 formed of one or more linear casings 112, 112', 112", and 112'", each of the one or more linear casings, referred to collectively as 112. In still other embodiments, a single casing 12 defines a breach 44 and is well suited for pre-planned breaches, as well as remote placement by a human or robot. The casing 12 is formed of materials illustratively including any type of steel, aluminum, aluminum alloys, and any combination of these with a liner 16.

At least one reaction initiator 22 is thermally coupled to the highly exothermic composition 20 and is adapted to ignite the highly exothermic composition 20. It is appreciated that a reaction initiator 22 is coupled external to casing 12 or is internal thereto. In some inventive embodiments the at least one reaction initiator 22 is any one of a fuse 24, an electric match 26 having an integral ignitor pellet 28 wired to a clacker 30, or a shock tube 32 connected to a pull ignitor 34. In some inventive embodiments, the clacker 30 is a U.S. Army M57 clacker. In other inventive embodiments, the pull ignitor 34 is a U.S. Army M60 or M81 pull ignitor. In some inventive embodiments, the one or more casings 12 is a plurality of casings such as 12-12'" joined together into a unitary shape by one or more connectors 36 to define the breach 44.

In some inventive embodiments, the at least one reaction initiator 22 is thermally coupled to the highly exothermic composition 20 and adapted to ignite the highly exothermic composition 20 and is disposed in each of the one or more connectors 36. In other inventive embodiments, the at least one reaction initiator 22 is disposed on an outer surface 45 of the at least one or more casings 12. In some inventive embodiments, the at least one reaction initiator 22 is a plurality of reaction initiators 22 disposed at multiple locations on the FUAD 10, illustratively including disposed both in at least one connector 36 and on an outer surface 45 of the at least one or more casings 12. It is appreciated that multiple reaction initiators 22 at multiple locations on the FUAD 10 allow for redundant initiation methods as a safety feature as well as a time saving feature. It is further appreciated that having multiple reaction initiators 22 that are a mix of manual ignition interfaces, such as the shock tube 32 connected to a pull ignitor 34 and electrical ignition interfaces, or the electric match 26 with integral ignitor pellet 28 wired to a clacker 30 so as to provide further fail safes and promote controlled ignition. As an additional safety feature, in some inventive embodiments, at least one reaction initiator 22 is capable of remote initiation via extending ignition wire 46 or wireless technology well known in the art illustratively including radio frequency transmission. In some inventive embodiments, a high temperature tolerant adhesive 42, illustratively including breacher's tape or high temperature adhesive, is disposed on an outer surface 45 of at least one of the one more casings 12. It is appreciated that the high temperature tolerant adhesive 42 is able to maintain adhesion to a breaching target substrate S up to a temperature of 4000° C. As best illustrated in FIG. 5, in some inventive embodiments, a high temperature tolerant adhesive 42 is disposed on an outer surface 47 of at least one of the one more connectors 36. In still other inventive embodiments, the storage stability of the highly exothermic composition 20, and the one or more casings 12 containing the highly exothermic composition 20 therein, have a pre-ignition storage stability that qualifies as Division 1.4—chemicals and items which present no significant hazard per OSHA Appendix B to Section 1910.1200 B.1.2 ("Chemicals and items which present only a small hazard in the event of ignition or initiation. The effects are largely confined to the package and no projection of fragments of appreciable size or range is to be expected. An external fire shall not cause virtually instantaneous explosion of almost the entire contents of the package").

Figure 2:
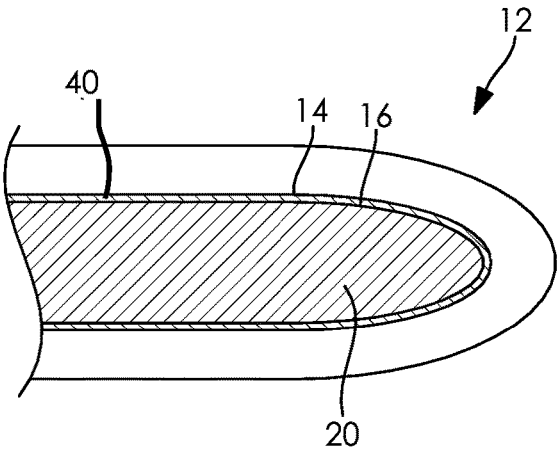
FIG. 2 is a cross-sectional view of a casing defining an annular bore.
Figure 3:
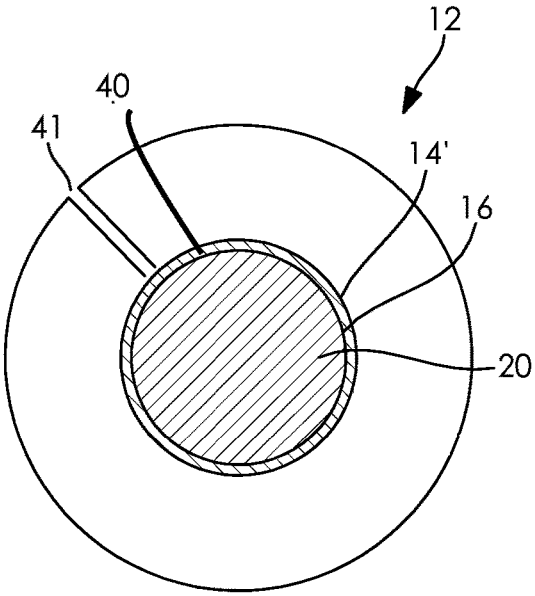
FIG. 3 is a cross-sectional view of a casing defining a circular bore.

With reference to the cross-sectional views of FIGS. 2 and 3, each of the one or more casings 12 collectively define a bore 14 or 14' having a core of the highly exothermic composition 20 contained therein and surrounded by a thermally insulating liner 16. It is appreciated that in some inventive embodiments the thermally insulating liner 16 is graphite. A thermal insulating liner according to the present invention is also illustratively formed of ceramics such as silica, alumina, ceria, zirconia, titania, and combinations thereof in both densified and porous forms. It is appreciated that porosity contributes to thermal insulating properties as evidenced by LI-900 tiles compared to densified silica.

The casing 12 defines a bore 14 or 14' having a core of the highly exothermic composition 20 contained therein and surrounded by the thermally insulating liner 16. In some inventive embodiments a metal propagator 40 is disposed in the bore 14 or 14'. It is appreciated that the metal propagator helps to propagate the highly exothermic composition post-ignition away from the at least one reaction initiator 22. In inventive embodiments, and as best shown in exemplary form in FIG. 3, the metal propagator 40 is a magnesium ribbon or a layer of magnesium wrapping disposed in the bore 14 or 14' and surrounding the highly exothermic composition 20. In some inventive embodiments, a slit 41 is provided in the one or more casings 12 to vent heat and gases from the propagator 40, as shown in exemplary form in FIG. 3.

The highly exothermic composition 20 is contained in the bore 14 or 14' and surrounded by the thermally insulating liner 16. In some inventive embodiments, the highly exothermic composition 20 is contained in the bore 14 or 14' at a loading pressure of between 175 and 375 kilograms per square centimeter. It is appreciated that the highly exothermic composition 20 is ignitable to create a post-ignition temperature of between 500° C. and 4000° C. In some inventive embodiments, the highly exothermic composition 20 is ignitable to create a post-ignition temperature of between 1000° C. and 3500° C.; while in other inventive embodiments, a post-ignition temperature of between 1500° C. and 2500° C. is generated.

In some inventive embodiments, the highly exothermic composition 20 is a thermite containing a metal and an oxide with which the metal undergoes an exothermic reduction-oxidation reaction that generates the aforementioned post-ignition temperature. It is appreciated that in inventive embodiments, the metal is at least one of aluminum, magnesium, zirconium, titanium, zinc, silicon, boron, calcium, copper, or combinations thereof. It is further appreciated that in inventive embodiments, the oxide is at least one of titanium dioxide, copper(II) oxide, chromium(III) oxide, iron(II, III) oxide, magnetite, manganese(IV) oxide, silicon dioxide, boron trioxide, lead(II, IV) oxide, zirconium oxide, or combinations thereof.

In some inventive embodiments, the metal is present in an amount of between 20 to 60 total weight percent of the highly exothermic composition 20 and the oxide being present as the remainder of the highly exothermic composition 20 without accounting for additives that promote the storage stability or ease of handling such as binding agents, desiccants, coolants, or combinations thereof.

Figure 4:
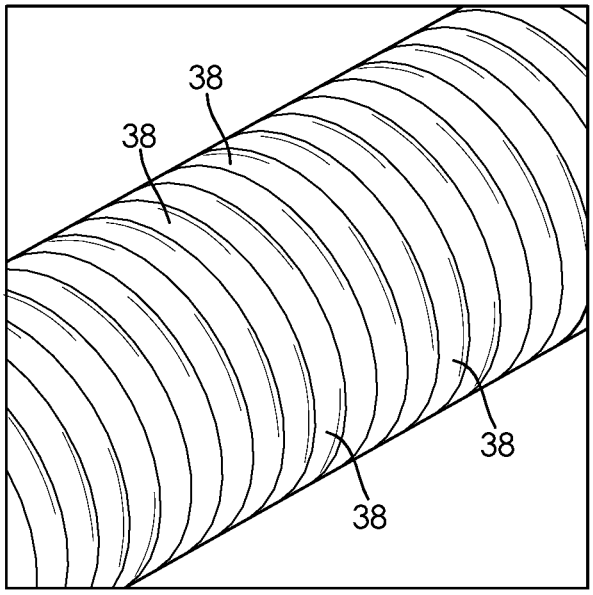
FIG. 4 is a perspective view of the casing of FIG. 3 the one or more casings formed from flexible interlocking rings defining a smooth texture and a sealed bore.

Referring now to FIG. 4, another embodiment of a casing 12 of the one or more casings 12 is illustrated. The casing 12 is formed from flexible interlocking rings 38 that define a smooth texture and seal the bore 14 defined therein. It is appreciated that the sealed bore 14 and smooth texture defined by the flexible interlocking rings 38 prevent impingement of a highly exothermic composition 20 contained therein. It is further appreciated that the flexible interlocking rings 38 impart a flexibility to the one or more casings 12 and ultimately to the FUAD 10 formed from the one or more casings 12. Flexible interlocking rings are routinely found in the construct of flexible metal conduit and illustratively detailed in U.S. Pat. No. 6,164,569A. It is still further appreciated that this flexibility allows the FUAD 10 to compensate for mild variations in surface curvature of various breaching target substrates S, and further allows the FUAD 10 to better conform to the shape and contour of various breaching target substrates S, thereby minimizing performance risks associated with curved surfaces of various breaching target substrates S, illustratively including automobile glass.

Referring now to FIG. 5, where like numerals have the meaning ascribed thereto with respect to the previous drawings, another embodiment of the FUAD 10 is illustrated with a plurality of casings 112, 112', 112", and 112'" joined together by one or more connectors 36 into a breach 44 that is rectilinear. These casings are referred to collectively as 112 and have the same properties as casing 12 with the exception of being linear instead of arcuate. The high temperature tolerant adhesive 42 is disposed on an outer surface 47 of the one or more connectors 36.

An inventive method is also provided for breaching a target. The method includes contacting the FUAD 10 with a breaching target substrate S, thermally coupling at least one reaction initiator 22 to the highly exothermic composition 20, triggering the at least one reaction initiator 22 thereby igniting the highly exothermic composition 20, and allowing the highly exothermic composition 20 to achieve a post-ignition temperature sufficient to melt the breaching target substrate S, forming a hole therethrough. It is appreciated that the post-ignition temperature achieved by the highly exothermic composition 20 is between 500° C. and 4000° C. It is further appreciated that the post-ignition temperature achieved by the highly exothermic composition 20 melts a variety of breaching target substrates S forming a hole therethrough without leaving sharp or jagged edges. It is still further appreciated that because the highly exothermic composition 20 achieves a post-ignition temperature of between 500° C. and 4000° C. without creating an explosive force, a hole is created in the breaching target substrate S with a high degree of accuracy and without compromising an outer area of the breaching target substrate S. Substrates breached by the present invention illustratively include soda lime glass, coated glass, metal wire reinforced glass, polyvinyl butyral laminated glass, bullet resistant films on bullet proof glass, tempered glass, high grade safety glass, layered films, steel, concrete, cement, clay, wood, plaster, marble, granite, ceramics, plastics, brick, polyaramid, multi pane glass, glass blocks, poly acrylics, polycarbonates, and other polymeric materials used in windows/clear dividers used to separate areas (between rooms, hallways, or indoors/outdoors), or combinations thereof. It is appreciated that embodiments of the inventive highly exothermic composition 20 post-ignition are able to melt through more than one glass panel concurrently. It is further appreciated that breaching target substrates S operative herein form a variety of structures illustratively including vehicle glass, vehicle body panels, buildings, bunkers, and the like.

In inventive embodiments, the thermally insulating liner 16 of the FUAD 10 focuses heat generated by the highly exothermic composition 20 post-ignition towards the breaching target substrate S that is in contact with the FUAD 10. In other inventive embodiments, at least one additive is intermixed with the highly exothermic composition 20. It is appreciated that the at least one additive modifies at least one property of storage stability, burn rate, post-ignition temperature, consistency of the highly exothermic composition, or a combination thereof. In some inventive embodiments, the at least one additive includes silicone oil, polyethylene glycol, sodium silicate, thermoset curing binders, or combinations thereof. It is appreciated that additives, when present, are between 1 to 30 parts by weight each and typically less than 50 parts by weight in total per 100 parts by weight of the highly exothermic composition. It is appreciated that a given additive is intermixing with the highly exothermic composition or as an adjacent layer thereto. In some inventive embodiments, the highly exothermic composition 20 is a putty. It is appreciated that the burn rate and/or temperature of the highly exothermic composition 20 post-ignition are further modifiable by adjusting the weight ratio of exothermic composition relative to additives (if present).

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient roadmap for implementing the exemplary embodiment or exemplary embodiments. It should be understood that various changes may be made in the function and arrangement of elements without departing from the scope as set forth in the appended claims and the legal equivalents thereof.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The invention claimed is:

1. An access device, comprising:

one or more casings, each of said one or more casings collectively defining a bore; and a core of a highly exothermic composition contained in said bore and surrounded by a thermally insulating liner, wherein said casing and said thermally insulating liner surround and enclose said highly exothermic composition with no nozzles being used so that no jets are formed when said highly exothermic composition is ignited, and wherein the highly exothermic composition is ignitable to create a post-ignition temperature of between 500° C. and 4000° C. so that said access device can melt through and breach a target substrate.

2. The access device of claim 1, further comprising at least one reaction initiator thermally coupled to said highly exothermic composition and adapted to ignite said highly exothermic composition.

3. The access device of claim 2, wherein said at least one reaction initiator is any one of a fuse, an electric match having an integral ignitor pellet wired to a clacker, or a shock tube connected to a pull ignitor.

4. The access device of claim 1, wherein said one or more casings is a plurality of casings and further comprising one or more connectors adapted to join each of said plurality of casings together into a shape to define a breach.

5. The access device of claim 4, further comprising at least one reaction initiator thermally coupled to said highly exothermic composition and adapted to ignite said highly exothermic composition, wherein said at least one reaction initiator is disposed in each of said one or more connectors.

6. The access device of claim 1, wherein each of said one or more casings is flexible.

7. The access device of claim 1, further comprising a metal propagator disposed in said bore.

8. The access device of claim 7, wherein said one or more casings has a slit therethrough and said metal propagator comprises a magnesium ribbon or a layer of magnesium wrapping surrounding the highly exothermic composition.

9. The access device of claim 1, wherein said highly exothermic composition is contained in said bore at a loading pressure of between 175 and 375 kilograms per square centimeter.

10. The access device of claim 1, further comprising a high-temperature tolerant adhesive disposed on an outer surface of at least one of said one or more casings, said adhesive able to maintain adhesion to a breaching target substrate up to a temperature of 4000° C.

11. The access device of claim 4, further comprising a high-temperature tolerant adhesive disposed on an outer surface of at least one of said one or more connectors, said adhesive able to maintain adhesion to a breaching target substrate up to a temperature of 4000° C.

12. The access device of claim 1, wherein said thermally insulating liner is graphite.

13. The access device of claim 1, further comprising at least one additive of silicone oil, polyethylene glycol, sodium silicate, thermoset curing binders, or combinations thereof added to said highly exothermic composition.

14. The access device of claim 1, wherein said highly exothermic composition comprises a thermite composition of metal and metal oxide.

15. A method of breaching a target, comprising:

contacting the access device of claim 1 with a breaching target substrate;

thermally coupling at least one reaction initiator to said highly exothermic composition;

triggering said at least one reaction initiator thereby igniting said highly exothermic composition; and wherein said highly exothermic composition achieves a post-ignition temperature sufficient to melt said breaching target substrate, forming a breach therethrough.

16. The method of claim 15, wherein said post-ignition temperature is between 500° C. and 4000° C.

17. The method of claim 15, wherein the thermally insulating liner of the access device is configured to focus heat generated by said highly exothermic composition post-ignition towards said breaching target substrate in contact with the access device.

18. The method of claim 15, wherein said breaching target substrate is at least one of soda lime glass; coated glass; metal wire reinforced glass; polyvinyl butyral laminated glass; bullet resistant films on bullet proof glass; tempered glass; high grade safety glass; layered films; steel; concrete; cement; clay; wood; plaster; marble; granite; ceramics; plastics; brick; polyaramid; multi pane glass; glass blocks; polymeric windows/clear dividers used to separate areas of between rooms, a room and a hallway, or indoors/outdoors; or combinations thereof.

19. The method of claim 15, further comprising modifying a configuration of said one or more casings to match a desired size and shape of a breach to be formed in said breaching target substrate.

20. The access device of claim 14, wherein said metal is at least one of aluminum, magnesium, zirconium, titanium, zinc, silicon, boron, calcium, copper, or combinations thereof, and said metal oxide is at least one of titanium dioxide, copper(II) oxide, chromium(III) oxide, iron(II, III) oxide, magnetite, manganese(IV) oxide, silicon dioxide, boron trioxide, lead(II, IV) oxide, zirconium oxide, or combinations thereof.

* * * * *